US005261261A

United States Patent [19]

Ramsey

[11] Patent Number: 5,261,261

[45] Date of Patent: Nov. 16, 1993

[54] METHOD AND APPARATUS FOR FORMING A FLUTED CAN BODY

[75] Inventor: Christopher P. Ramsey, Uffington, United Kingdom

[73] Assignee: CarnaudMetalbox plc, United Kingdom

[21] Appl. No.: 806,513

[22] Filed: Dec. 13, 1991

[30] Foreign Application Priority Data

Dec. 21, 1990 [GB] United Kingdom ..... 9027854
Nov. 1, 1991 [GB] United Kingdom ..... 9123259

[51] Int. Cl.[5] ..... B21D 15/02

[52] U.S. Cl. ..... 72/105; 72/92; 72/379.4

[58] Field of Search ..... 72/105, 102, 106, 465, 72/133, 92, 91, 379.4

[56] References Cited

U.S. PATENT DOCUMENTS

| | | | |
|---|---|---|---|
| 666,672 | 1/1901 | Hoffman | 72/105 |
| 1,378,442 | 5/1921 | Chalfant . | |
| 1,605,828 | 11/1926 | Frahm . | |
| 2,101,309 | 12/1937 | Burns | 72/92 |
| 4,169,537 | 10/1979 | Sabreen et al. | 220/70 |
| 4,246,770 | 1/1981 | Franek et al. | 72/92 |
| 4,487,048 | 12/1984 | Frei | 72/94 |
| 4,578,976 | 4/1986 | Shulski et al. | 72/105 |
| 4,756,174 | 7/1988 | Anderson et al. | 72/106 |
| 5,040,698 | 8/1991 | Ramsey et al. | 220/671 |

FOREIGN PATENT DOCUMENTS

| | | |
|---|---|---|
| 889981 | 3/1959 | United Kingdom . |
| 1361437 | 12/1971 | United Kingdom . |
| WO91/11275 | 1/1990 | World Int. Prop. O. . |

*Primary Examiner*—Lowell A. Larson
*Assistant Examiner*—Michael J. McKeon
*Attorney, Agent, or Firm*—Diller, Ramik & Wight

[57] ABSTRACT

A method and apparatus are described for forming a plurality of axially extending externally concave complete flutes defining a fluted profile in a cylindrical can body 1. The apparatus comprises a correspondingly profiled mandrel 11 of maximum diameter less than the minimum diameter of the cylindrical can body and comprising a whole number of complete flutes which is less than the number of flutes on the finished can body, an elongate rail 14, means 12 for locating a cylindrical can body over the mandrel, and means 10 for rolling the mandrel relative to the rail to deform a portion of the cylindrical can body between the mandrel and the rail into the fluted profile.

15 Claims, 9 Drawing Sheets

METHOD AND APPARATUS FOR FORMING A FLUTED CAN BODY

BACKGROUND OF THE INVENTION

1. Field of the Invention

This invention relates to containers and in particular to metal can bodies having an end wall and, upstanding from the periphery of the end wall, a side wall which includes a plurality of longitudinal flexible panels forming a fluted profile; and more particularly but not exclusively, to metal can bodies intended to be closed by a lid such as are used to container processed foods.

2. Description of Related Art

U.S. Pat. No. 4,578,976 describes a can body embossing apparatus which includes a can body supporting embossing mandrel which has circumferentially-spaced axially-extending ribs on its periphery that are engageable with a resilient forming member so that parallel, axially-extending crease lines are formed on the can body.

The applicants earlier UK Patent Aplication GB-A-2237550 describes can bodies having a fluted profile provided by complete flutes and the present invention relates to an improvement in such can bodies and to a method and apparatus for their manufacture. Adjacent crease lines will define axially extending concave flutes therebetween. The axial ends of these flutes however will be undefined and the flutes will not be complete, that is, they will not have a closed perimeter defining the axial ends as well as the sides of the flutes.

SUMMARY OF THE INVENTION

In the design of the fluted profile there are two major criteria. The first is that the perimeter of the fully formed can body in the fluted region is equal to the original can body circumference, thus forming involves the minimum degree of material stretch, tool wear, and container damage. The second is that the envelope remains constant—that is that the outermost points of the fluted region lie on the same diameter as the original can body. This is important for subsequent labelling and handling.

According to a first aspect the invention provides a method of forming a plurality of axially extending externally concave complete flutes in a cylindrical can body, the method comprising the steps of locating the cylindrical can body on an internal correspondingly profiled mandrel; wherein the profile of the mandrel comprises a whole number of axially extending externally concave complete flutes which is less than the number of flutes on the finished can body, and rolling the mandrel relative to an external rail thereby deforming a portion of the cylindrical can body between the mandrel and the rail to form the flutes.

According to a second aspect the invention provides apparatus for forming a plurality of axially extending externally concave complete flutes in a cylindrical can body, the apparatus comprising a correspondingly profiled mandrel of maximum diameter less than the minimum diameter of the cylindrical can body and comprising a whole number of axially extending externally concave complete flutes which is less than the number of flutes on the finished can body, an elongate rail, means for locating a cylindrical can body over the mandrel, and means for rolling the mandrel relative to the rail to deform a portion of the cylindrical can body between the mandrel and the rail to form the flutes.

According to a third aspect the invention provides a can body comprising a bottom end wall and an upstanding cylindrical side wall of radius R, wherein a portion of the side wall is formed with a plurality of axially extending externally concave complete flutes defining a fluted profile in that portion of the side wall, each flute profile comprising a part circular externally concave section of radius U located within the circle of the cylindrical side wall and connected to that circle through part circular externally convex sections of radius P, wherein the radii U and P are related to the radius R by the equation $R=U+2P$ and wherein the circles of the externally convex sections are tangential both to the circles of the concave sections and to the circle of the cylindrical side wall.

DESCRIPTION OF THE PREFERRED EMBODIMENTS

Figure 1:
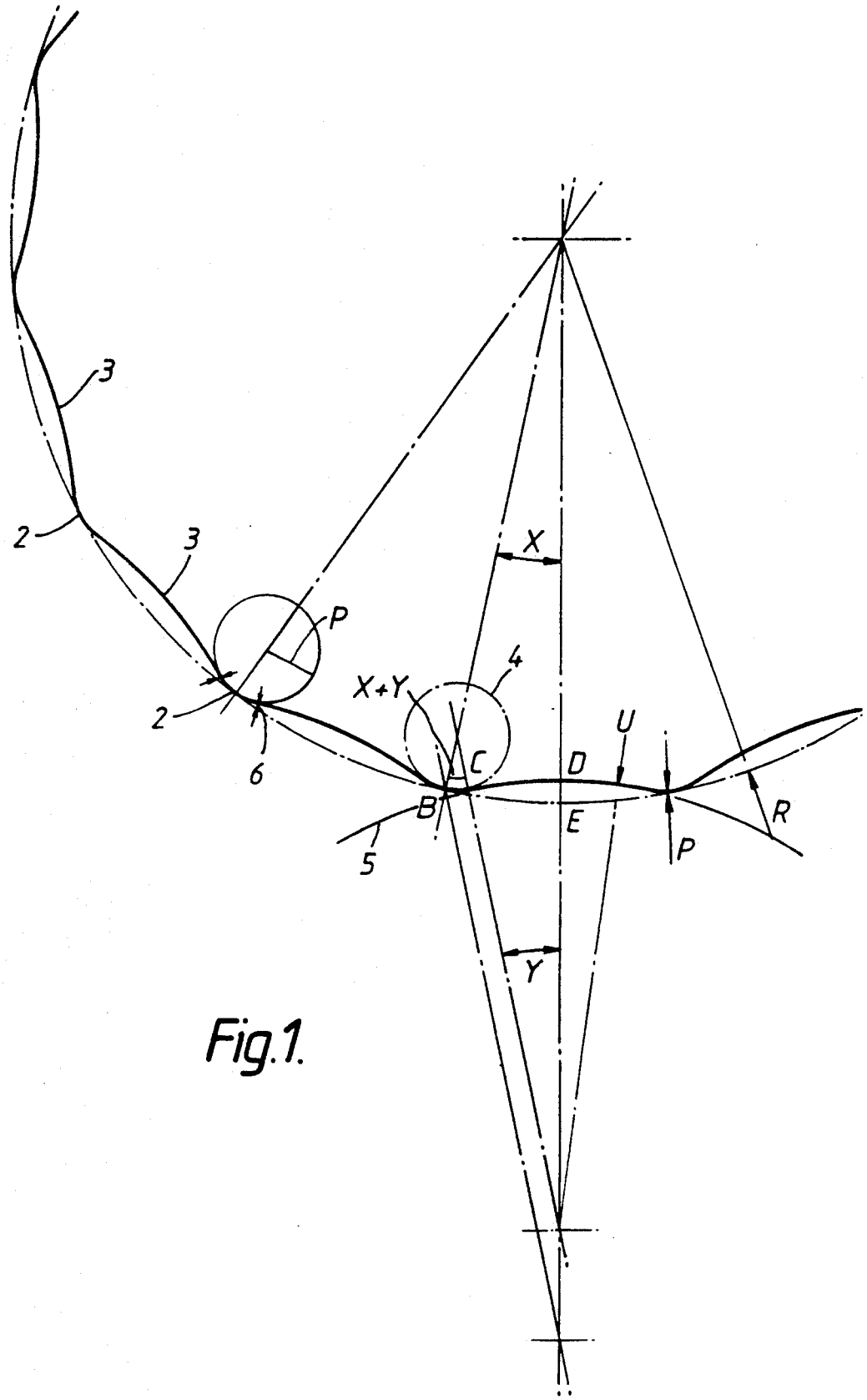
FIG. 1 is a diagrammatic partial profile of the fluted portion of a first embodiment of can body.
Figure 2:
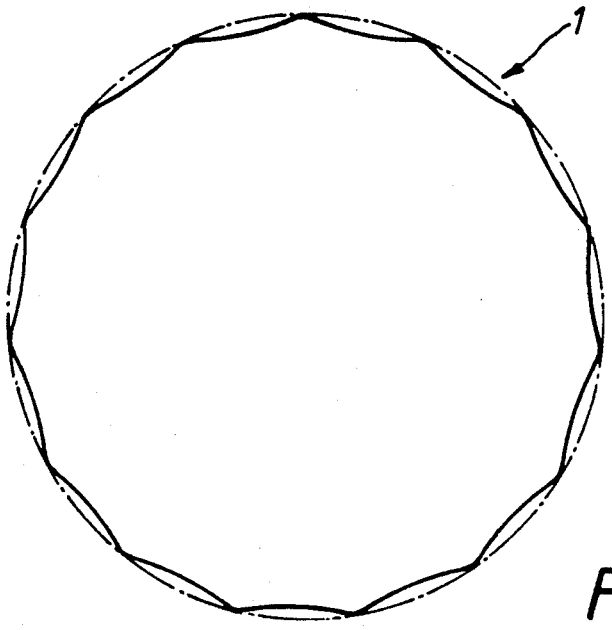
FIGS. 2 and 3 show can profiles before and during processing.
Figure 3:
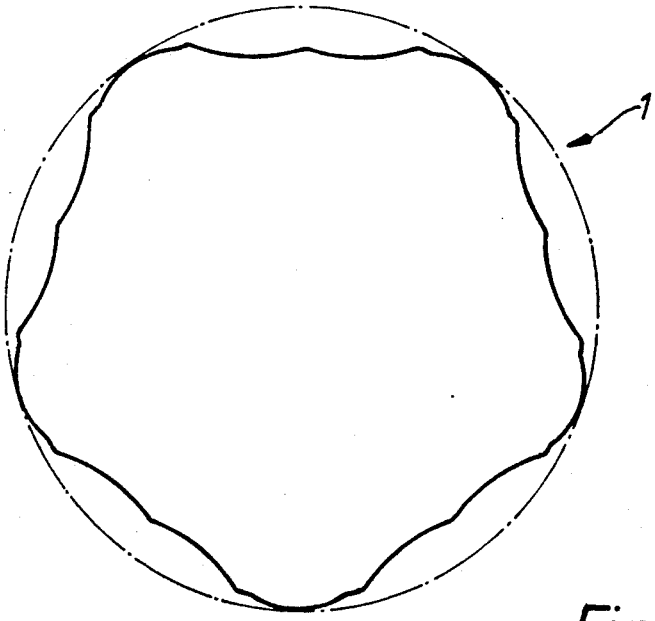

Referring to FIGS. 1-3, it can be seen that the fluted portion of the can body 1 has a profile consisting of externally convex peak sections 2 of radius P alternating with externally concave flute sections 3 of radius U. The sections 2 and 3 are of constant radius over their full circumferential extent and run smoothly into one another. This is achieved by making the circles 4,5 of the sections 2 and 3 tangential to one another at the junctions 6 between the convex and concave sections. The circles 4 are also tangential to the circle of the cylindrical side wall.

Since the profile is formed solely of part circular sections the following analysis is possible.

Considering angle values in radians

Arc length $BE=RX$

Arc length $BC=(X+Y)P$

Arc length $CD=UY$

Now, one of the major requirements for the design is that the perimeter of the fluted portion of the can body remains unchanged by the formation of the flutes. It is thus required that $$BE=BC+CD$$

substituting into this equation gives $$XR=(X+Y)P+BY$$

$$\text{or } X(R-P)=Y(U+P) \quad (1)$$

Resolving horizontally.

$$R \sin X=P(\sin X+\sin Y)+U \sin Y$$

$$\sin X\,(R-P)=\sin Y\,(U+P) \quad (2)$$

Dividing (2) by (1), gives $$\frac{\sin X}{X}=\frac{\sin Y}{Y} \quad (3)$$

solving this gives $$X=Y$$

putting this into (1) gives $$R=U+2P \quad (4)$$

Given a can body of known radius, the profile of the fluted portion can be determined by selecting the peak radius P and the number of flutes.

The ratio of flute radius to peak radius is preferably at least 20:1, this large ratio maximises the flute depth. Advantages of flute depth are as follows:

a) increased strength of the vertical beam formed at the peaks, thus when the can sees an external overpressure, the beam flexes inwards without buckling.
b) improved abuse resistance of the can after processing package, again due to beam strength.
c) it reduces the tendency for the flutes to permanently unfold during processing, when there is a high internal pressure.

Note that the peak radii should not be too small as this may cause localised stress concentrations during forming, processing, or handling which may lead to material splitting. Typically the ratio of peak radius to material thickness should be between 5:1 and 20:1, particularly 10:1.

The optimum nuber of flutes for a given application depends on; the container aspect ratio, material type and temper, material thickness, the type of product, the ratio of product to container volume, the filling, processing, and storage conditions, and the handling requirements.

Basically the smaller the number of flutes the better the processing and abuse performance, but the lower the effective fill volume, the ability to form the profile, and label the container.

In the case of food cans, there is a further simplifying factor in determining the optimum number of flutes for a given application, this is that the number of flutes must be a multiple of three. The reason for this can be seen with reference to FIG. 3. When subject to an external overpressure the can reduces in volume by means of an elastic panelling mechanism in which each 'panel' is made up of two full flutes which flex radially inwards, and two half flutes, which flip through to a convex profile effetively producing an elastic hinge.

Combining the 'multiple of three' principle with forming, processing, labelling, and abuse constraints the number of flutes for foodcan applications become 12, 15, 18 and 21, particularly 15 and 18. For a 73 mm diameter, 110 mm high petfood container the optimum is 15 flutes.

Unlike conventional circumferential bead forming, each vertical flute must be fully formed in a single operation before the next flute is formed. Thus the can is formed in a single revolution of a mandrel as described below.

The reason for this stems from the constant perimeter and constant envelope constraints, thus if the flute is formed to the full depth there will be excess material leading to an incorrect flute pitch.

In order to form the flutes it is proposed to use an internal mandrel rolling against an external rail. The internal mndrel must have a smaller diameter than the can because otherwise it would be impossible to remove the can from the mandrel after forming.

The mandrel must have a whole number of flutes, for example if the can has 15 flutes the mandrel must have a whole number of flutes which is less than 15. In practice the lower limit of the number of flutes on the mandrel is defined largely by the stiffness requirement of the mandrel, for a can with 15 flutes the lower limit providing adequate stiffness would be about 6 flutes on the mandrel.

Figure 4:
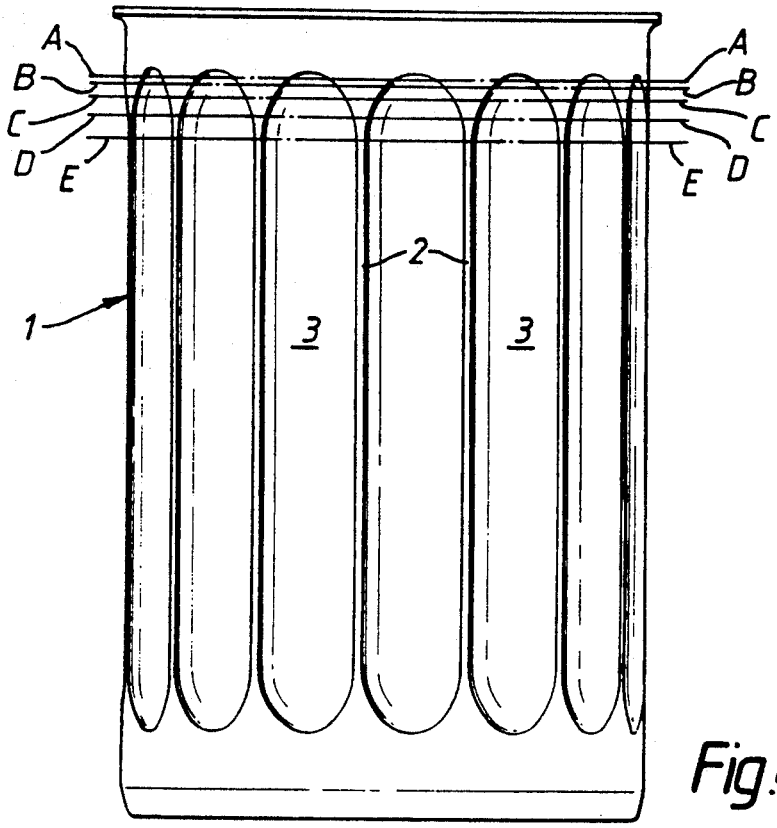
FIG. 4 is a side view of the can body.
Figure 5:
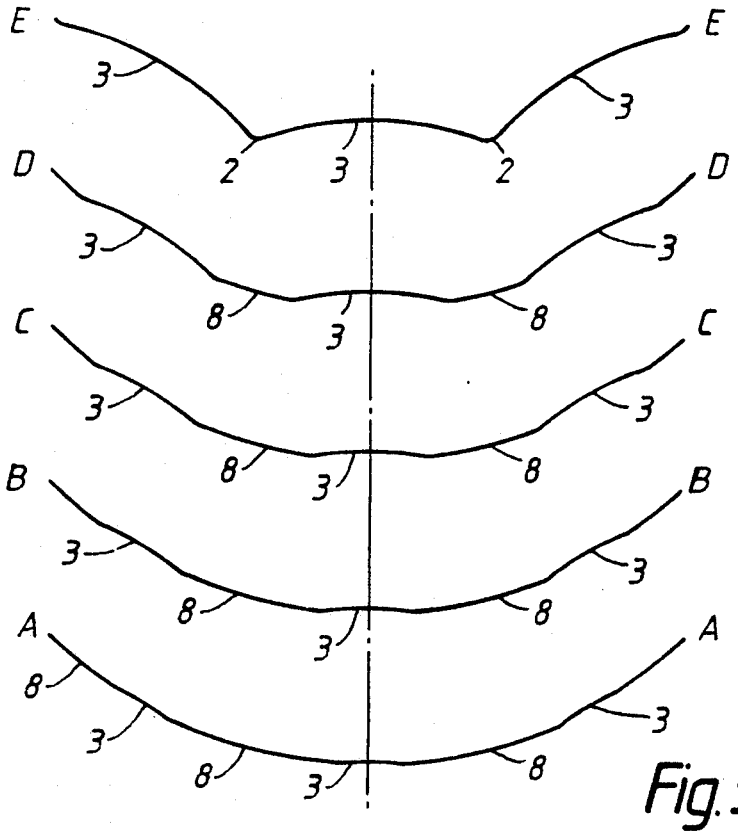
FIG. 5 shows a series of partial profiles of the can body of FIG. 4 taken on lines A—A to E—E in FIG. 4.

FIGS. 4 and 5 show the shape of the can profile at the flute top and bottom. This is made by projecting a half oval onto the cylindrical can surface, and then defining sections circumferentially across the oval to have constant envelope and constant perimeter.

Considering the curves DD-AA in FIG. 5 it will be seen that the profile of the peaks 2 in this region is now interrupted by a cylindrical section 8. The concave flute sections of this profile are of the same radius U but become progressively shallower. These shallow flute sections are the size as would occur in the central region of a can body having 17, 22, 30 or 45 flutes respectively. In this manner, the constant perimeter requirement is maintained in these end regions of the flutes and the flutes are complete—that is, they have a closed perimeter defining the ends as well as the sides of the flutes. In order to form such complete flutes it is important that the flutes on the mandrel are also complete.

The benefits of the half oval shape come from minimal material stretch, and good axial load capacity. A sudden change of profile would cause a high stress concentration and failure at this point under axial load.

Figure 6:
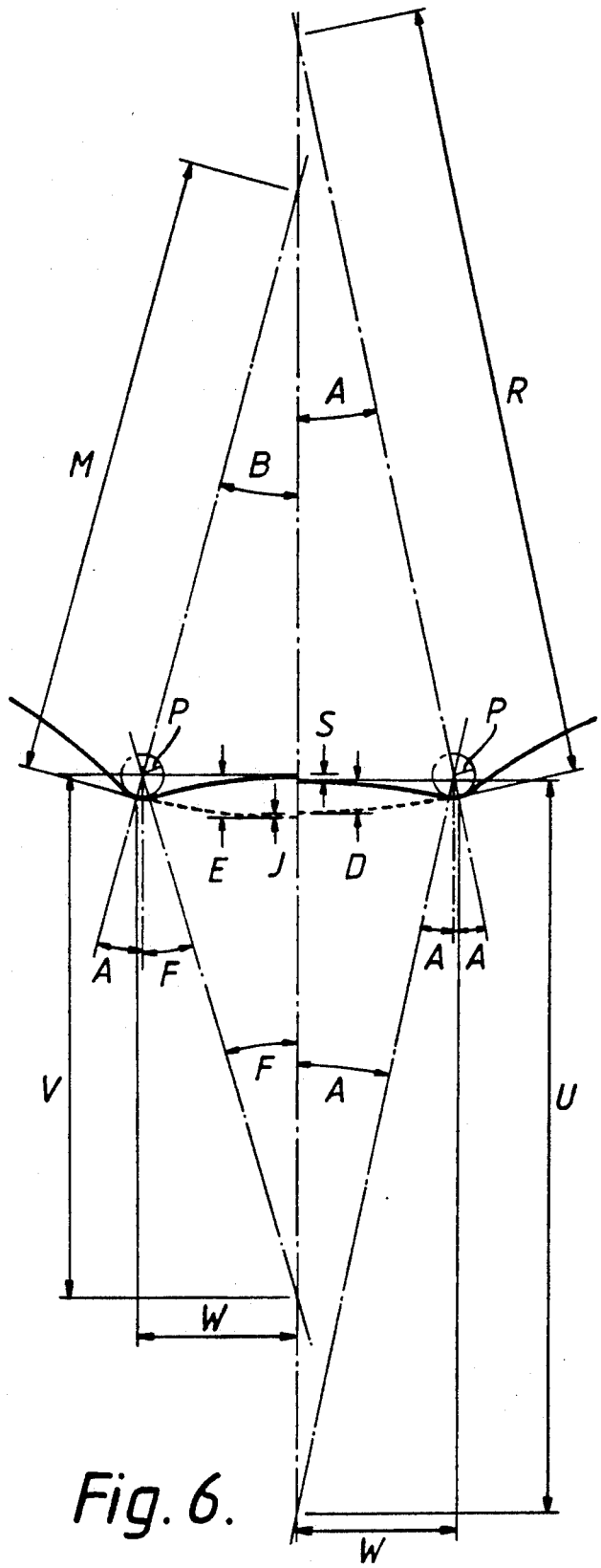
FIG. 6 is a split diagrammatic partial view of the mandrel profile (shown on the left) and the can body profile (shown on the right)

FIG. 6, shows a split section through a flute, with the mandrel profile on the left, and the can profile on the right.

Nomenclature used is as follows:

R—Internal can radius
M—Mandrel radius
P—Peak radius of mandrel and can
N—Number of flutes on can
T—Difference between the number of flutes on the can and mandrel A—Can half flute angle
B—Mandrel half flute angle
F—Mandrel half flute coincidence angle
U—Can flute radius
V—Mandrel flute radius
D—Can flute depth
E—Mandrel flute depth
S—Can springback depth
K—Springback factor where K=S/D
W—Half flute width.

Mandrel radius $$A = \frac{\pi}{N} \tag{5}$$

$$B = \frac{\pi}{N - T} \tag{6}$$

$$\sin A = \frac{W}{R} \quad W = R \sin A$$

$$\sin B = \frac{W}{M}, \; M = \frac{W}{\sin B} = R\frac{\sin A}{\sin B} \tag{7}$$

Subst. 5. and 6. into 7.

$$M = \frac{R \sin \pi/N}{\sin \pi/(N - T)} \tag{8}$$

Can flute depth $$D = R - R\cos A + U - U\cos A \tag{9}$$

Subst. 4 into 9.

$$\begin{aligned} D &= R(1 - \cos A) + (R - 2P)(1 - \cos A) \\ &= 2(R - P)(1 - \cos A) \end{aligned} \tag{10}$$

Mandrel flute depth $$\begin{aligned} E - J &= R - R\cos A - (P - P\cos B) + \\ &\quad P - P\cos F + V - V\cos F \\ &= R(1 - \cos A) + P(\cos B - \cos F) + \\ &\quad V(1 - \cos F) \end{aligned} \tag{11}$$

$$J = M(1 - \cos B) - R(1 - \cos A) \tag{12}$$

Add 11. and 12.

$$E = M(1 - \cos B) + P(\cos B - \cos F) + V(1 - \cos F) \tag{13}$$

Mandrel flute radius

From experimental results it has been shown that for a given material thickness and temper, the 'springback depth' S is proportional to the can flute depth.

$$\begin{aligned} S - KD &= E - J - D \\ E - J &= D(K + 1) \end{aligned} \tag{14}$$

Subst. 10. and 11. into 14

$$R(1 - \cos A) + P(\cos B - \cos F) + V(1 - \cos F) = 2(R - P)(1 - \cos A)(K + 1) \tag{15}$$

Resolving about the $X$-axis:

$$R \sin A = P(\sin B + \sin F) + V \sin F$$

$$V = \frac{R \sin A - P(\sin B + \sin F)}{\sin F} \tag{16}$$

Subst. 16. into 15.:

$$R(1 - \cos A) + P(\cos B - \cos F) + \tag{17}$$

-continued $$((R \sin A) - P(\sin B + \sin F))\frac{(1 - \cos F)}{\sin F} = 2(R - P)(1 - \cos A)(K + 1)$$

Equation 17 may be used to solve iteratively for F, which can then be substituted into 16. to give V.

The following table shows an example of the above equations used to design a 12 flute mandrel for a 15 flute can. The first column of data is used for the main flute profile, and the rest are used to define sections through the half oval flute end profiles.

TABLE

| | | | | | | |
|---|---|---|---|---|---|---|
| R | internal can radius | 36.435 | | | | |
| P | peak radius | 1 | | | | |
| K | springback factor | 0.19 | | | | |
| N | no. of flutes on can | 15 | 17 | 2 | 30 | 45 |
| A | can half flute angle | 12 | 10.588 | 8.1818 | 6 | 4 |
| B | mandrel half flute angle | 15 | 12.857 | 9.4737 | 6.6667 | 4.2857 |
| F | mandrel half flute coincidence angle | 16.62 | 14.66 | 11.325 | 8.3 | 5.53 |
| A | radians | 0.2094 | 0.1848 | 0.1428 | 0.1047 | 0.0698 |
| B | radians | 0.2618 | 0.2244 | 0.1653 | 0.1164 | 0.0748 |
| F | radians | 0.2901 | 0.2559 | 0.1977 | 0.1449 | 0.0965 |
| E | mandrel flute depth | 2.044 | 1.5699 | 0.9172 | 0.4842 | 0.2118 |
| M | mandrel radius | 29.269 | | | | |
| D | can flute depth | 1.5487 | 1.2067 | 0.7214 | 0.3882 | 0.1726 |
| S | can springback depth | 0.2942 | 0.2293 | 0.1371 | 0.0738 | 0.0328 |
| V | mandrel flute radius | 24.58 | 24.574 | 24.567 | 24.578 | 24.598 |
| T | no. can-mandrel flutes | 3 | 3 | 3 | 3 | 3 |

Dimensions in millimeters

Figure 7:
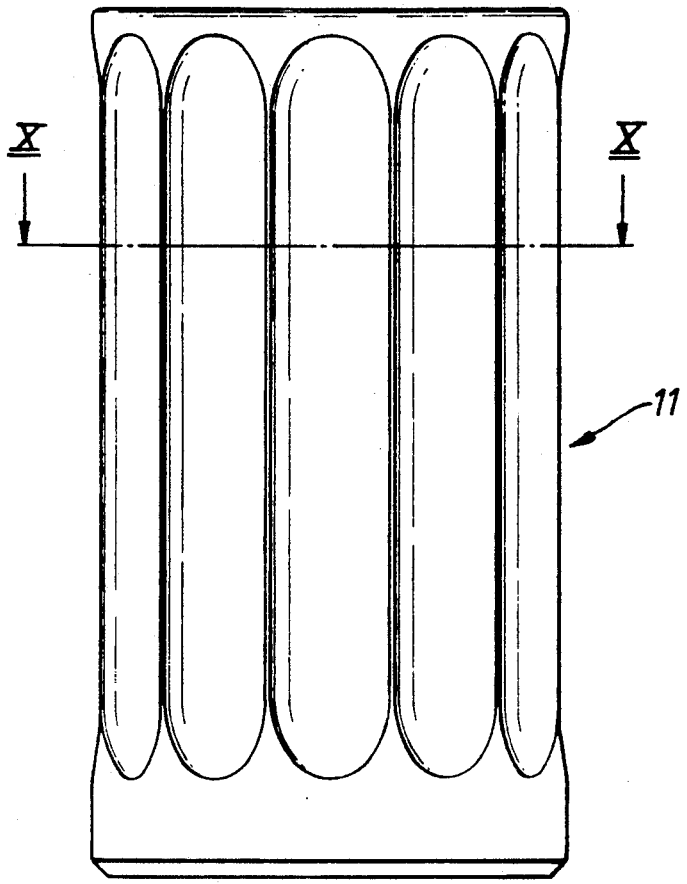
FIG. 7 is a side view of a mandrel used in forming the can body.
Figure 8:
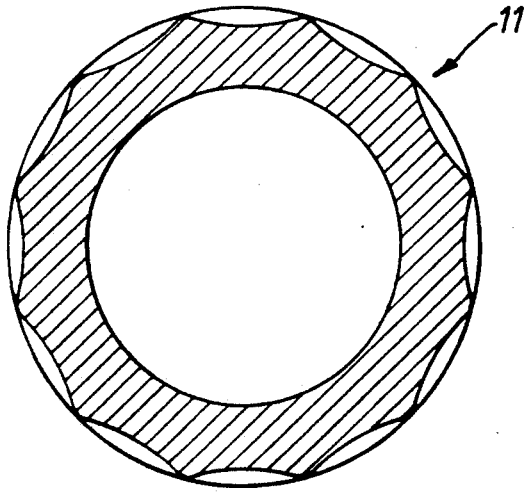
FIG. 8 is a cross-section of the mandrel shown in FIG. 7 taken along the line X—X.
Figure 9:
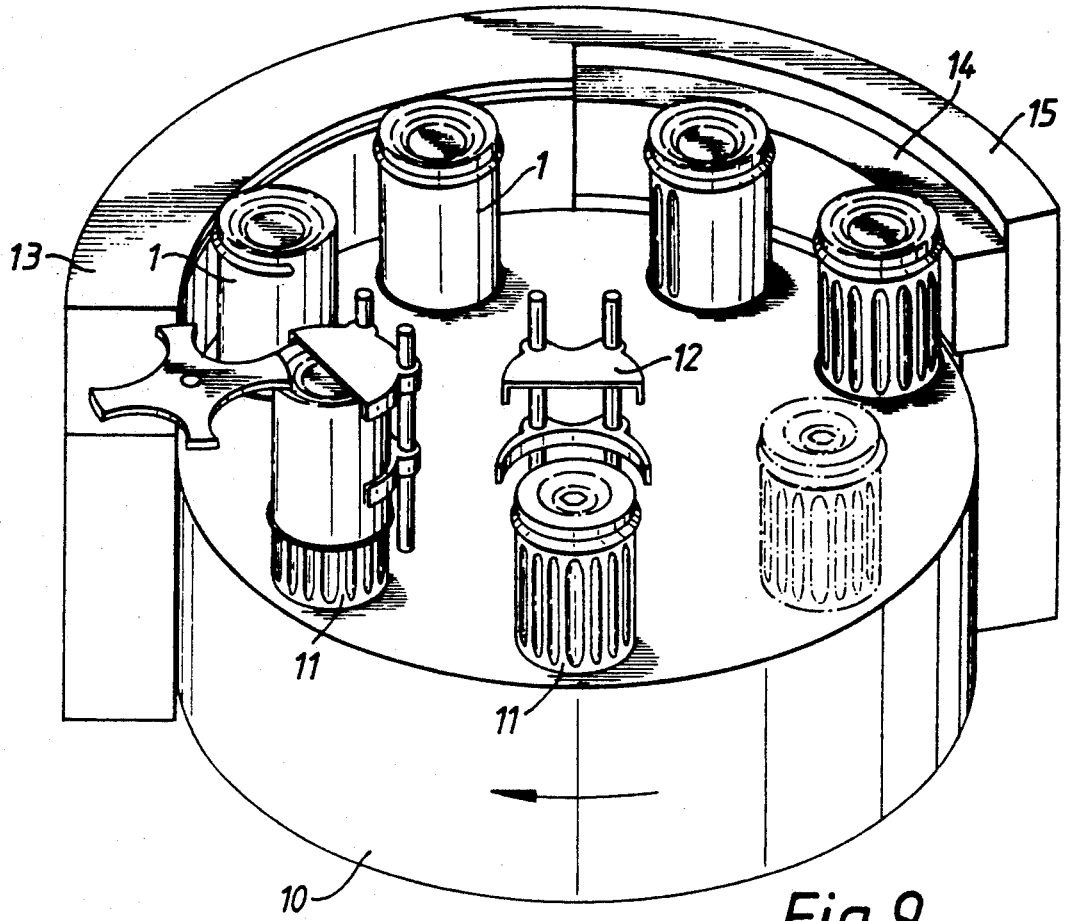
FIG. 9 is a diagrammatic perspective view of apparatus for forming a can body.
Figure 13:
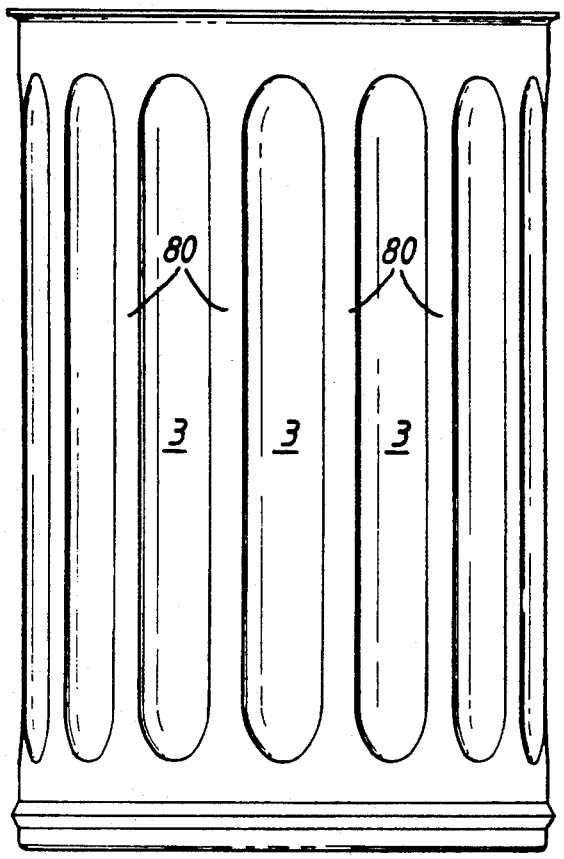
FIG. 13 is a side view of another embodiment of can body.

FIGS. 7 and 8 show a mandrel 11 designed according to the above method. The mandrel has 12 flutes for forming a 15 flute can body. The mandrel may also be formed with an external bead at the bottom for forming a roll bead on the can body as shown in FIGS. 9 and 13.

Figure 10:
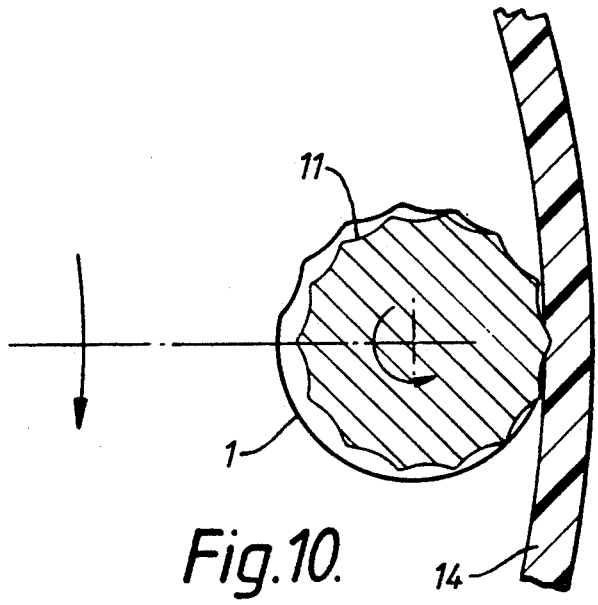
FIG. 10 is a diagrammatic view of the mandrel and rail of FIG. 9.

Machines are known (e.g. as shown in U.S. Pat. No. 4,512,490) which form vertical flutes in cans using a solid internal and external mandrel. We believe, however, that a preferable method is to use an internal mandrel running against an external forming rail, as shown in FIGS. 9 and 10.

Advantages of this method are as follows:

Only one set of external tooling is required for the complete machine, thus reducing cost, setting time, and maintenance.

The head pitch can be reduced thus reducing machine size, and increasing machine speed.

No drive system is required for the external tooling thus reducing machine cost.

Forming of roll bead and vertical flutes are possible on the same machine. (Since the roll bead requires at least two revolutions, and the flutes require exactly one, it is not possible to combine these operations using an external mandrel type machine.)

Two types of forming rail can be used on the machine; flexible and solid.

For flexible tooling (FIGS. 9 and 10), the rail 14 is made up of an arcuate polyurethane block of rectangular section, mounted against a rigid backing plate 15. Rail arc length is set to provide a single flute lead-in to full forming depth, plus one complete revolution of forming. Width is sufficient to just extend over the flute ends, and thickness is around 10 times the forming depth. Polyurethane shore 'A' hardnesses of between 60 and 95 are suitable, especially 75 to 85.

Benefits of this type of flexible rail are the minimal manufacturing cost, plus no requirement to align the internal tooling, thus a friction drive may be used for the internal mandrels.

In FIG. 9 apparatus employing a flexible outer rail is shown. In this apparatus a rotating turret 10 carries a number of mandrels 11 each rotatably mounted on the turret on shafts (not shown). Can bodies are fed onto the mandrels and initially held in position by cam-operated holding means 12. As the turret rotates the can bodies engage a roll bead forming rail 13. The shafts of the mandrels are driven so that the mandrels and can bodies thereon roll along the rail 13. Apparatus of this kind for forming roll beads in can bodies is well known and it is therefore not described in more detail. After formation of the roll bead cans engage a flexible rail 14 which deforms the can body against the mandrel as the mandrel rolls along the rail 14. After the flutes have been formed the cans are removed from the apparatus in known manner.

In FIG. 10 it can be seen that the resilient rail is locally deformed by the action of the mandrel.

Figure 11:
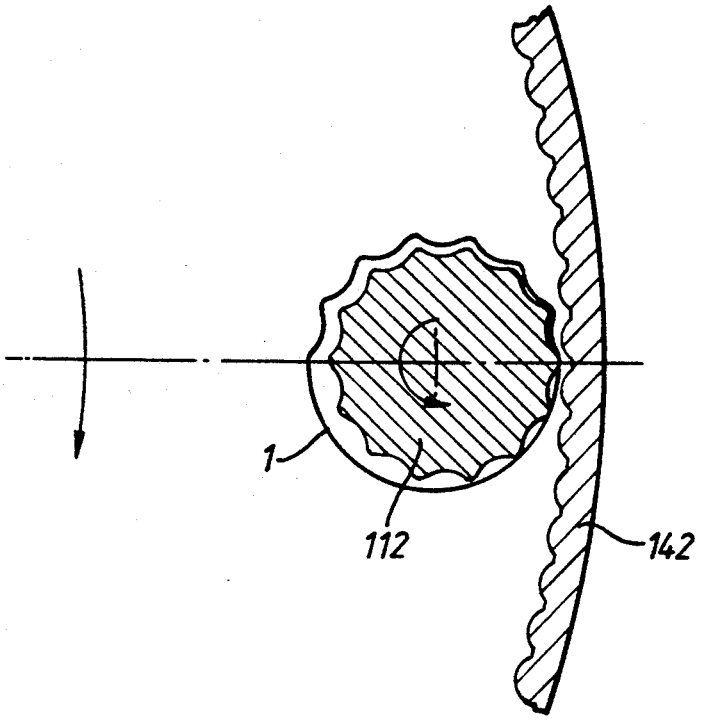
FIG. 11 is a diagrammatic view of an alternative mandrel and rail for forming a can body.
Figure 12:
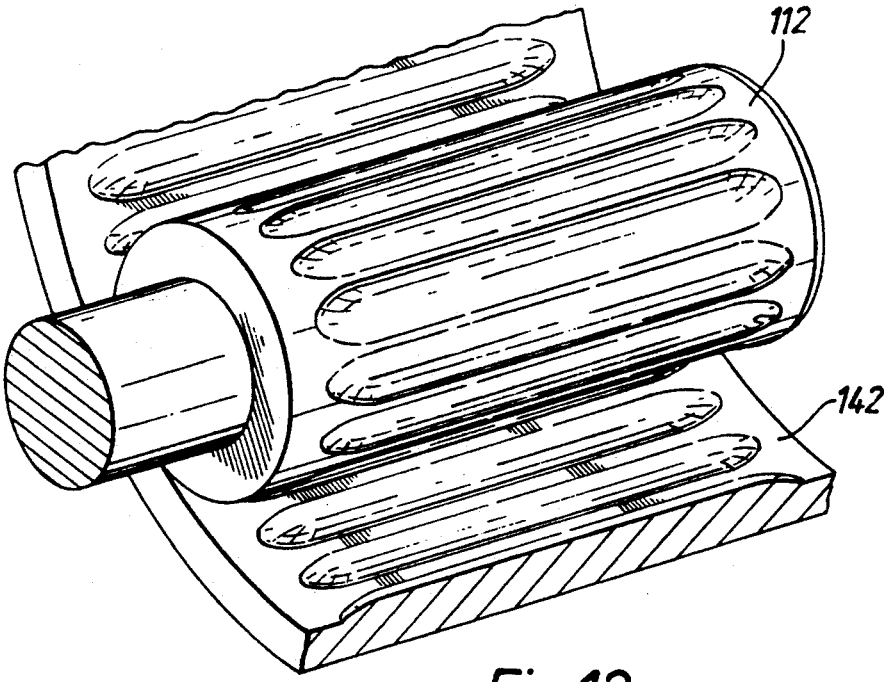
FIG. 12 is a perspective sketch of the mandrel of FIG. 11.

An alternative arrangement, using a solid metal forming rail, is shown in FIGS. 11 and 12. In this apparatus a mandrel 112 cooperates with a metal forming rail 142.

Solid external tooling uses the same tool design information as for the flexible tooling, the difference being that the rail 142 carries the flute profile, and the internal mandrel 112 the peak profile. At no time is the can nipped between the tooling thus there is minimal material damage.

Note that, as with flexible tooling, the flutes on the mandrel are complete, that is, they have an enclosed perimeter defining these ends as well as their sides, as seen in FIG. 12.

Solid tooling has a much longer operating life than flexible, but requires very accurate matching of forming depth and peripheral speed.

Figure 14:
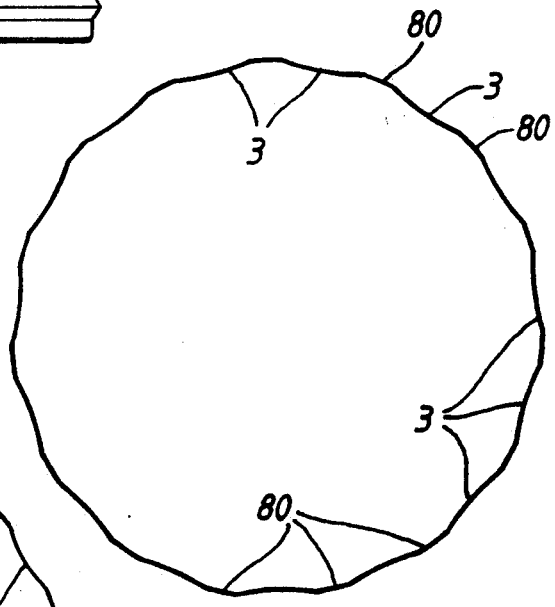
FIG. 14 is a section taken on the line XIII—XIII of FIG. 13.
Figure 16:
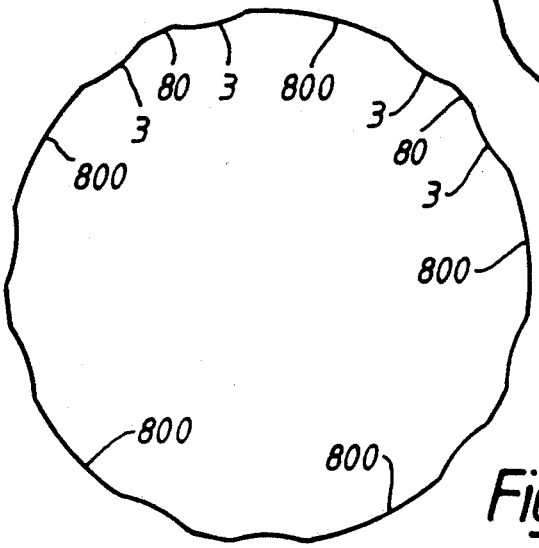
FIG. 16 is a horizontal cross-section through a further embodiment of can body.
Figure 15:
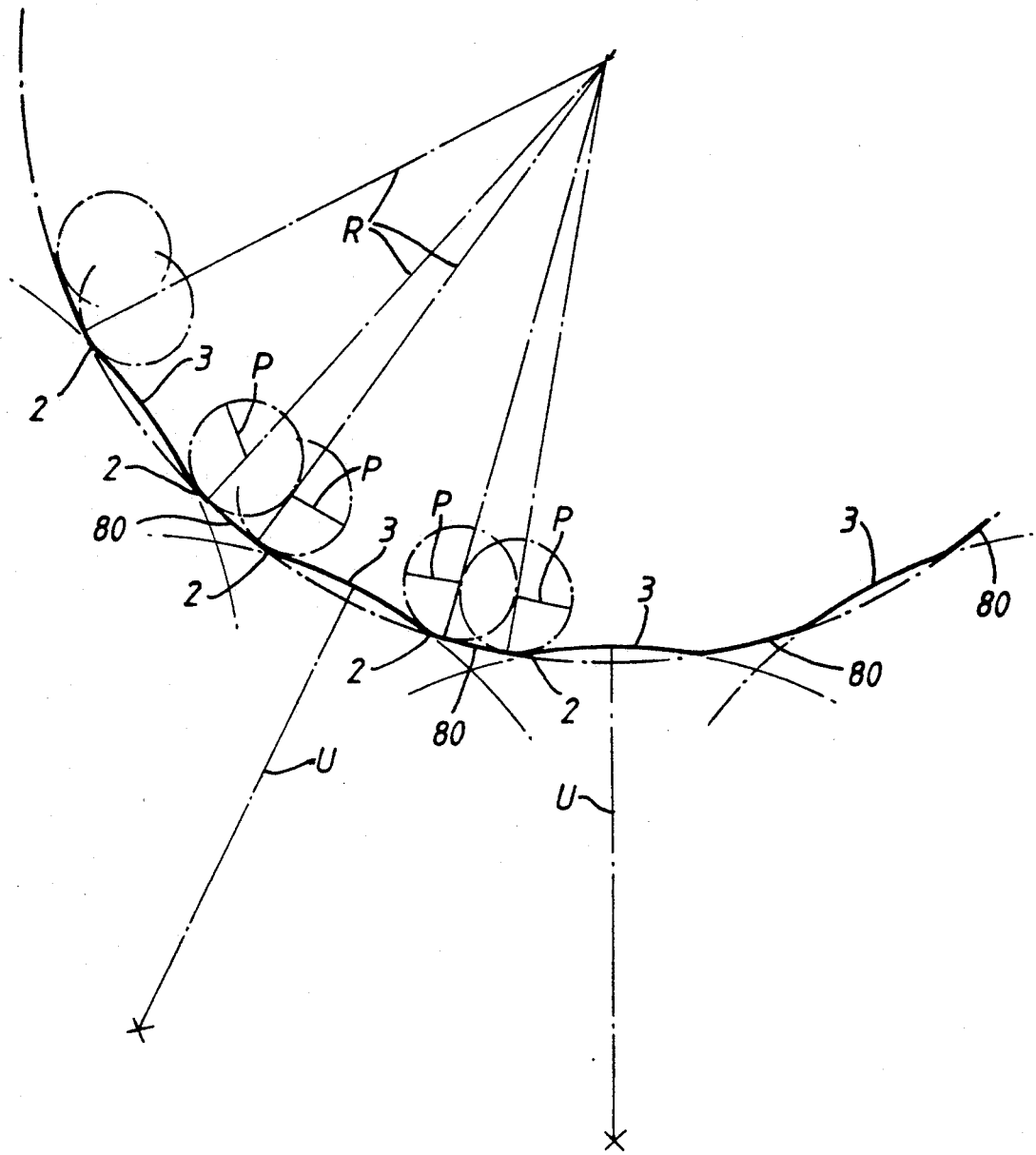
FIG. 15 is an enlarged view showing part of the fluted profile of the can body of FIGS. 13 and 14.

FIGS. 13–15 show an alternative embodiment of a cylindrical can body in which adjacent flutes are separated by cylindrical plain wall sections 80. As can be seen from FIGS. 14 and 15 in particular, the profile of the can body in the fluted region is similar to the profiles shown in FIGS. 5A–5D. The radius U of the concave sections 3 and the radius P of the convex sections 2 connecting the concave sections to the cylindrical plain wall sections 80 are the same as in the embodiment of FIGS. 1–5. The flutes are shallower, however, and thus have a lesser circumferential extent, the difference being made up by the plain cylindrical sections 80. In effect, the peaks of the embodiment of FIGS. 1–5 have been interrupted by the plain cylindrical sections 80. In the embodiment shown in FIGS. 13–15 the flutes are equispaced and of equal size. In such a can, the peripheral extent of the plain cylindrical sections is up to 60%, and particularly 30%, of the peripheral extent of the flutes. In another embodiment shown in FIG. 16, a cylindrical can body similar to that of FIGS. 13–15 has every third flute missing such that a number of large plain cylindrical sections 800 are formed. In a modification of the embodiment of FIG. 16, not shown, the small plain cylindrical sections are omitted so that the flutes in those regions run directly into one another through convex peaks as in the embodiment of FIGS. 1–5.

The embodiments of FIGS. 13–16 provide the same collapse and re-expansion mechanism as the embodiment of FIGS. 1–5 as well as the same axial performance. There is, however, a reduced expansion capability as a result of the flutes being shallower. On the other hand, the embodiments of FIGS. 13–16 have advantages in relation to labelling; being better able to pick up labels in cut and stack labelling machines and exhibiting minimal label bagginess over the flutes which are relatively shallow.

The profiles of the embodiment of FIGS. 13–16 satisfy the equation $R=U+2P$ and can be formed in the same way as the embodiment of FIGS. 1–5 except that a corresponding change to the profile of the forming tools is required.

I claim:

1. A method of forming a plurality of axially extending externally concave complete flutes in an originally unfluted cylindrical metal can body having a predetermined circumferential perimeter length, the method comprising the steps of locating the cylindrical can body on an internal profiled mandrel in which the profile of the mandrel comprises a whole number of axially extending externally arcuate concave complete recesses having axially opposite half-oval shaped ends which is less than the number of flutes on the finished can body, and rolling the mandrel relative to an external rail to deform a portion of the cylindrical can body between the mandrel and the rail to form the flutes having axially opposite half-oval shaped ends generally absent stretch of the metal can body and while generally maintaining the circumferential perimeter length of the can body as measured at any position in the fluted region unchanged from the circumferential perimeter length of the unfluted can body with outer points of the flutes lying on substantially the same diameter as the diameter of the unfluted can body.

2. The method of claim 1 wherein the external rail is a block of elastomer.

3. The method of any claims 1–2 wherein the profile of the mandrel and a profile of the rail are calculated by the equations:

$$V = R\,\frac{\sin A - P(\sin B + \sin F)}{\sin F}$$

and $$R(1 - \cos A) + P(\mathrm{Cos}\,B - \cos F) + ((R \sin A) - P(\mathrm{Sin}\,B + \sin F))\,\frac{(1 - \cos F}{\sin F} = 2(R - P)\,1 - \cos A)(K + 1)$$

wherein:

A is the can half flute angle,

B is the mandrel half flute angle,

F is the mandrel half flute coincidence angle,

K is the springback factor calculated as the ratio of can springback depth (S) to can flute depth (D), namely, S/D, P is the peak radius of mandrel and can, R is the internal can radius, and V is the mandrel flute radius.

4. The method of claim 1 wherein the external rail is a profiled metal rail and wherein the internal mandrel is profiled to form the externally convex sections of the can body and the rail is profiled to form the externally concave sections of the can body.

5. The method of claim 4 wherein the profile of the mandrel and the profile of the rail are calculated by the equations:

$$V = \frac{R \sin A - P(\sin B + \sin F)}{\sin F}$$

and $$R(1 - \cos A) + P(\text{Cos } B - \cos F) + ((R \sin A) - P(\text{Sin } B + \sin F)) \frac{(1 - \cos F}{\sin F} = 2(R - P)\, 1 - \cos A)(K + 1)$$

wherein:

A is the can half flute angle,
B is the mandrel half flute angle,
F is the mandrel half flute coincidence angle,
K is the springback factor calculated as the ratio of can springback depth (S) to can flute depth (D), namely, S/D,
P is the peak radius of mandrel and can,
R is the internal can radius, and
V is the mandrel flute radius.

6. The method of claim 1 wherein the profile of each concave recess as viewed in radial cross-section consists only of part-circular arcs.

7. The method of claim 1 wherein the external rail includes flexible material which deforms in general conformity with the deformation of the cylindrical can body portion during the rolling of the flutes therein.

8. The method of claim 1 wherein the cylindrical can body is rotated substantially only a single revolution to completely flute the entire circumferential perimeter length thereof.

9. Apparatus for forming a plurality of axially extending externally concave complete flutes in an originally unfluted cylindrical metal can body having a predetermined circumferential perimeter length, the apparatus comprising a corresponding profiled mandrel of maximum diameter less than the minimum diameter of the cylindrical can body and comprising a whole number of axially extending externally arcuate concave complete recess having axially opposite half-oval shaped ends which is less than the number of flutes on the finished can body, an elongate rail, means for locating a cylindrical can body over the mandrel, and means for rolling the mandrel relative to the rail to deform a portion of the cylindrical can body between the mandrel and the rail to form the flutes generally absent stretch of the metal can body and while generally maintaining the circumferential perimeter length of the can body as measured at any position in the fluted region unchanged from the circumferential perimeter length of the unfluted can body with outer points of the flutes lying on substantially the same diameter as the diameter of the unfluted can body.

10. Apparatus as claimed in claim 9 wherein the elongate rail is resilient and is a block of elastomer.

11. Apparatus as claimed in claim 9 wherein the external rail is a profiled metal rail and wherein the internal mandrel is profiled to form the externally convex sections of the can body and the rail is profiled to form the externally concave sections of the can body.

12. Apparatus as claimed in claim 9 wherein the profile of the mandrel and the profile of the rail are calculated by the equations:

$$V = R \frac{\sin A - P(\sin B + \sin F)}{\sin F}$$

and $$R(1 - \cos A) + P(\text{Cos } B - \cos F) + ((R \sin A) - P(\text{Sin } B + \sin F)) \frac{(1 - \cos F}{\sin F} = 2(R - P)\, 1 - \cos A)(K + 1)$$

wherein:

A is the can half flute angle,
B is the mandrel half flute angle,
F is the mandrel half flute coincidence angle,
K is the springback factor calculated as the ratio of can springback depth (S) to can flute depth (D), namely, S/D,
P is the peak radius of mandrel and can,
R is the internal can radius, and
V is the mandrel flute radius.

13. The apparatus as defined in claim 9 wherein the profile of each concave recess as viewed in radial cross-section consists only of part-circular arcs.

14. The apparatus of claim 9 wherein the external rail includes flexible material which deforms in general conformity with the deformation of the cylindrical can body portion during the rolling of the flutes therein.

15. The apparatus of claim 9 wherein the cylindrical can body is rotated substantially only a single revolution to completely flute the entire circumferential perimeter length thereof.

* * * * *